US007819639B2

(12) United States Patent
Nakken

(10) Patent No.: US 7,819,639 B2
(45) Date of Patent: Oct. 26, 2010

(54) COOLING DEVICE FOR PISTON MACHINERY

(75) Inventor: Mareno Kennet Nakken, Fiksdal (NO)

(73) Assignee: Sperre Mek. Verksted AS, Ellingsoy (NO)

( * ) Notice: Subject to any disclaimer, the term of this patent is extended or adjusted under 35 U.S.C. 154(b) by 318 days.

(21) Appl. No.: 11/233,577

(22) Filed: Sep. 22, 2005

(65) Prior Publication Data

US 2006/0067839 A1 Mar. 30, 2006

(30) Foreign Application Priority Data

Sep. 24, 2004 (NO) ..... 20044052

(51) Int. Cl.
*F04B 39/02* (2006.01)
*F04B 39/06* (2006.01)

(52) U.S. Cl. ..... 417/366; 417/243; 417/254

(58) Field of Classification Search ..... 417/153, 417/164, 173, 201, 313, 366, 368, 372, 243, 417/244, 254, 423.14; 165/121, 122, 127, 165/47; 415/182.1; 62/403, 469, 508
See application file for complete search history.

(56) References Cited

U.S. PATENT DOCUMENTS 3,835,918 A * 9/1974 Pilarczyk ..... 165/47
3,912,000 A * 10/1975 Nyeste ..... 165/47
4,190,402 A * 2/1980 Meece et al. ..... 417/415
4,492,533 A 1/1985 Tsuge
4,725,210 A * 2/1988 Suzuki et al. ..... 418/83
4,784,585 A * 11/1988 Hata et al. ..... 417/372
4,830,580 A * 5/1989 Hata et al. ..... 417/243
4,929,161 A * 5/1990 Aoki et al. ..... 418/83
4,961,405 A * 10/1990 Dorsch ..... 123/41.61
5,020,973 A * 6/1991 Lammers ..... 417/243
5,106,270 A 4/1992 Goettel et al.
5,240,648 A * 8/1993 Gill et al. ..... 261/30
5,507,618 A 4/1996 Kubo et al.
5,613,843 A * 3/1997 Tsuru et al. ..... 417/313
5,718,563 A * 2/1998 Hutchinson ..... 417/32
6,210,132 B1 * 4/2001 Shiinoki et al. ..... 417/410.5
6,447,264 B1 * 9/2002 Lucas et al. ..... 417/313

(Continued)

FOREIGN PATENT DOCUMENTS

EP 0 889 236 A2 1/1999

(Continued)

*Primary Examiner*—Devon C Kramer
*Assistant Examiner*—Amene S Bayou
(74) *Attorney, Agent, or Firm*—Merchant & Gould P.C.

(57) ABSTRACT

The invention relates to a cooling device for a compressor 100 which is provided with an intermediate heat exchanger 112 and an output heat exchanger 102 for cooling of compressed gas. The cooling device is enclosed by a jacket 200. The jacket has an air intake opening 202, connected to a radial fan 105 which provides an overpressure inside the jacket 200. The heat exchangers 102, 112 are mounted in air outlet openings 204, 206 in the jacket, with the result that the overpressure in the jacket 200 leads to cooling of the heat exchangers 102, 112. The jacket further comprises an additional outlet opening 208 for discharge of air used for cooling other elements of the compressor, such as cylinder walls, covers/tops and crankcases. The relationship between the different cooling processes can be influenced by the design of the openings 204, 206, 208 in the jacket 200.

9 Claims, 4 Drawing Sheets

U.S. PATENT DOCUMENTS

| | | | | |
|---|---|---|---|---|
| 6,474,954 | B1 | 11/2002 | Bell et al. | |
| 6,629,825 | B2 * | 10/2003 | Stickland et al. | 417/362 |
| 6,692,235 | B2 * | 2/2004 | Kolodziej et al. | 417/243 |
| 6,790,012 | B2 * | 9/2004 | Sharp et al. | 417/201 |
| 6,790,126 | B2 * | 9/2004 | Wood et al. | 451/41 |
| 6,793,465 | B2 * | 9/2004 | Stallings | 417/312 |
| 2002/0009372 | A1 * | 1/2002 | Gruber et al. | 417/234 |
| 2002/0106288 | A1 | 8/2002 | Lucas et al. | |

FOREIGN PATENT DOCUMENTS

| | | | |
|---|---|---|---|
| EP | 1 229 243 | A2 | 8/2002 |
| WO | 01/69083 | A2 | 9/2001 |

* cited by examiner

COOLING DEVICE FOR PISTON MACHINERY

CROSS REFERENCE TO RELATED APPLICATIONS

This application claims priority from Norwegian Patent Application No. 20044052, filed Sep. 24, 2004 and is hereby incorporated by reference in its entirety.

TECHNICAL FIELD

The present invention relates to the field of piston machinery such as a gas compressor, and particularly a cooling device for an air compressor.

BACKGROUND OF THE INVENTION

Mechanical compressors, such as electrically driven, multi-stage cylinder compressors are well-known in the art. The term compressor here should be understood to refer to a device for delivering compressed gas (including air), for example to a pressure tank or for direct use.

Such compressors require cooling. There is partly a need for cooling of the compressed gas delivered by the compressor, and partly for cooling of the actual compressor in order to avoid overheating and mechanical damage. In the case of multi-stage compressors there is also a need for cooling of the compressed gas between one stage and the next.

Solutions are previously known for air cooling of compressors. For example, it is previously known to place an axial fan in the extension of the compressor's drive shaft or a separately driven fan with, for example, an electromotor in front of the compressor, in order thereby to provide a movement of heated air from the compressor housing and from the gas coolers (i.e. the heat exchangers) that are connected after the individual compressor stage.

According to many known solutions the same air will cool the compressor's heat exchangers and hot surfaces. This results in less efficient cooling of hot surfaces since the cooling air is already heated by the heat exchangers. In other previously known solutions the same air will cool the compressor's hot surfaces before cooling the heat exchangers. In these cases the cooling of the heat exchangers will be less efficient since the cooling air is already heated by the hot surfaces. In most of the known cases the compressor draws in air that is heated by the heat exchangers and/or the hot surfaces. This reduces the efficiency and increases the need for cooling of compressed air and of the components that are in contact with the compressed air. In previously known solutions the cooling air will not be passed as efficiently over the parts that require cooling. A portion of the air will pass outside and is therefore ineffective. A relatively large and energy-demanding fan is required to compensate for this loss.

According to previously known solutions open uncovered compressor structures have been employed to a great extent with the object of increasing the air replacement and thereby increasing cooling efficiency. Such open structures cause the compressor to produce more noise and it is more exposed to external influences such as, for example, dust, particles, water splashes and blows. At the same time hot surfaces and sharp edges on the compressor will represent a safety risk.

SUMMARY OF THE INVENTION

An object of the invention is to provide a cooling device for a piston engine such as a compressor, where the disadvantages of the prior art are completely or partly redressed.

According to the invention the said objects are achieved with a cooling device for a piston engine such as an air compressor which is provided with at least one output heat exchanger for cooling of output air, which cooling device is characterised by

- a jacket enclosing the whole or parts of the compressor,
- an air intake opening in the jacket,
- a fan in connection with the air intake opening, which fan during operation causes an overpressure inside the jacket,
- a first air outlet opening in the jacket, where for cooling of output air from the compressor the output heat exchanger is mounted in the first air outlet opening, and
- at least one air outlet opening in the jacket for discharge of air which cools the compressor, whereby the overpressure in the jacket leads to air flow for cooling of the output heat exchanger and cooling of the necessary parts of the compressor.

In different embodiments of the invention the compressor may be a multi-stage cylinder compressor, comprising a first and a second compressor stage.

An intermediate heat exchanger may be mounted between the first and the second compressor stages, where the intermediate heat exchanger is mounted in a second air outlet opening in the jacket, whereby the overpressure in the jacket leads to air flow for cooling of the intermediate heat exchanger.

The fan may be a radial fan.

The compressor may be driven by a motor and the fan driven by the compressor, whereby the air contained in the jacket is caused to flow inside the jacket during operation.

The compressor may comprise additional compressor elements that have to be cooled during operation, where the jacket is mounted at a distance from the additional compressor elements, whereby the air flow inside the jacket cools the additional compressor elements.

The additional compressor elements that have to be cooled comprise at least a cylinder wall, cylinder cover/tops and crankcase.

The additional compressor elements that have to be cooled further comprise a separator device for separating water from the air in the compressor.

The jacket may comprise one or more of the third air outlet openings arranged on the opposite side of the air intake opening.

The air flow restrictions represented by the air intake opening and the air outlet openings in the jacket are adapted to influence the cooling of compressor elements relative to the cooling of the heat exchangers.

The intake of the compressor may comprise an air filter and is arranged to receive air directly supplied by the fan. A compressor intake for supplying air to the compressor may be provided inside or outside the jacket.

BRIEF DESCRIPTION OF THE DRAWINGS

The following drawings illustrate an advantageous embodiment of the invention.

Together with the description the drawings serve to explain the principles of the invention.

DETAILED DESCRIPTION OF THE INVENTION

Figure 1:
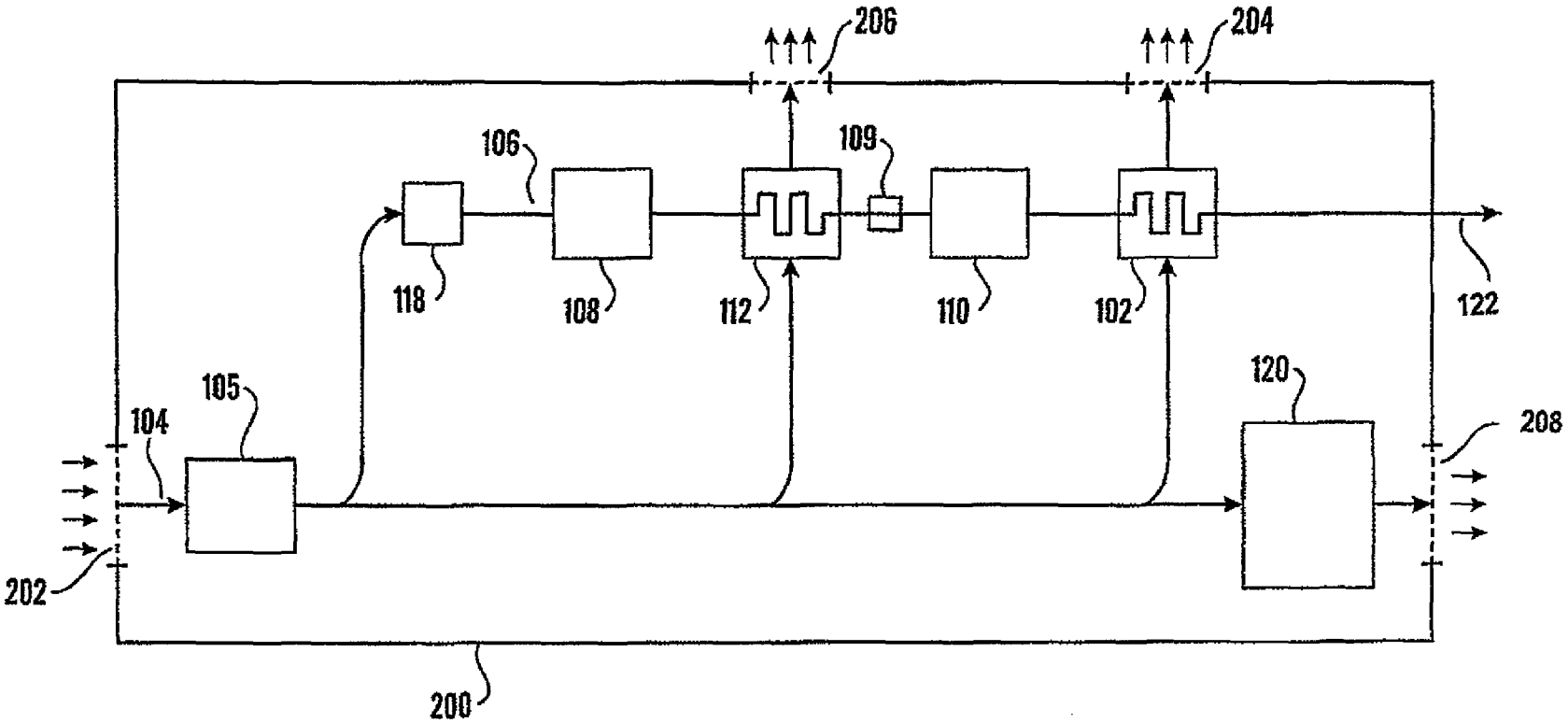
FIG. 1 is a schematic block diagram illustrating the principle of a cooling device for an air compressor according to the invention.

The invention will now be described in greater detail as an embodiment with reference to the drawings. Where possible the same reference numerals are employed for identical elements in the different drawings.

FIG. 1 is a schematic block diagram illustrating the principle of a cooling device for an air compressor according to the invention. Further and more detailed explanations are given below with reference to FIGS. 2 and 3.

The air compressor is a two-stage compressor, with an intermediate compressor stage 108 and an output compressor stage 110. The intermediate compressor stage 108 is followed by an intermediate heat exchanger 112 in the form of an air-to-air heat exchanger. Here the compressed air is cooled and passed on to the output compressor stage 110. The output compressor stage 110 is followed by an output heat exchanger 102. Here the compressed air from the output compressor stage 110 is cooled and passed on to a compressor outlet 122 for the air compressor. From the compressor outlet 122 compressed air is supplied, for example, to a pressure tank and/or to other, externally connected equipment.

A jacket 200, also called a shield by those skilled in the art, encloses the air compressor 100. The jacket 200 is essentially airtight, substantially with the exception of the openings 202, 204, 206, and 208.

The air intake opening 202 is directly connected to an intake 104 for a fan 105, which when operating causes an overpressure inside the jacket 200. The overpressure causes air to be forced out of the openings 206, 204, 208 in the jacket. The fan is preferably a radial fan. The fan inlet in the surrounding shield, moreover, is preferably conical in shape, tapering towards the fan's centre opening. The conical shape continues preferably into the centre of the fan. This provides better flow conditions for surrounding air into the fan.

A portion of the air supplied by the fan 105 is taken up by an air filter 118 which is further connected with the intake 106 of the first compressor stage 108 in the air compressor. This air portion is compressed in the compressor and delivered to the compressor outlet 122. The air intake 106 with the filter 118 are mounted inside the jacket, preferably in the immediate vicinity of the outlet from the fan 105. A supply of relatively cold air is thereby provided into the compressor stages, preferably also with a marginal overpressure from the fan 105.

The remainder of the air from the fan 105 is distributed to the air outlets 204, 206, 208 after having passed the different parts of the compressor's components to varying degrees.

The output heat exchanger 102 is mounted in the air outlet opening 204. The air leaving the air outlet opening 204 is therefore used for cooling the compressed air that is passed through the output heat exchanger 102. The portion of air that is to be used for cooling the output heat exchanger 102 can be influenced by the design of the restriction represented by the air outlet opening 204. The simplest way of doing this is to adjust the size of the effective area of the opening 204. The size of the heat exchanger 102 is preferably similar to the opening 204.

The intermediate heat exchanger 112 is mounted in the air outlet opening 206. The air leaving the air outlet opening 206 is therefore used for cooling the compressed air that is passed through the intermediate heat exchanger 112. The portion of air that is to be used for cooling the intermediate heat exchanger 112 can be influenced by the design of the restriction represented by the air outlet opening 206. The simplest way of doing this is to adjust the size of the effective area of the opening 206. In this case too the size of the heat exchanger 112 is preferably similar to the opening 206.

The fan 105 is preferably a radial fan. The radial fan will both provide the said overpressure as well as causing the air inside the jacket 200 to form an air flow. An air flow is thereby produced past and around the different elements of the compressor, including the elements that have a substantial need for cooling. For purposes of illustration, the elements of the compressor that are particularly affected and cooled by the flowing air are schematically illustrated by 120. These elements primarily comprise the cylinder walls and cylinder covers/tops followed by the crankcase. Special separator devices may also be provided for removing moisture from the compressed air, and such devices may also be included in the elements 120.

The air portion that has passed these elements 120 is discharged from the air outlet opening 208.

Figure 2:
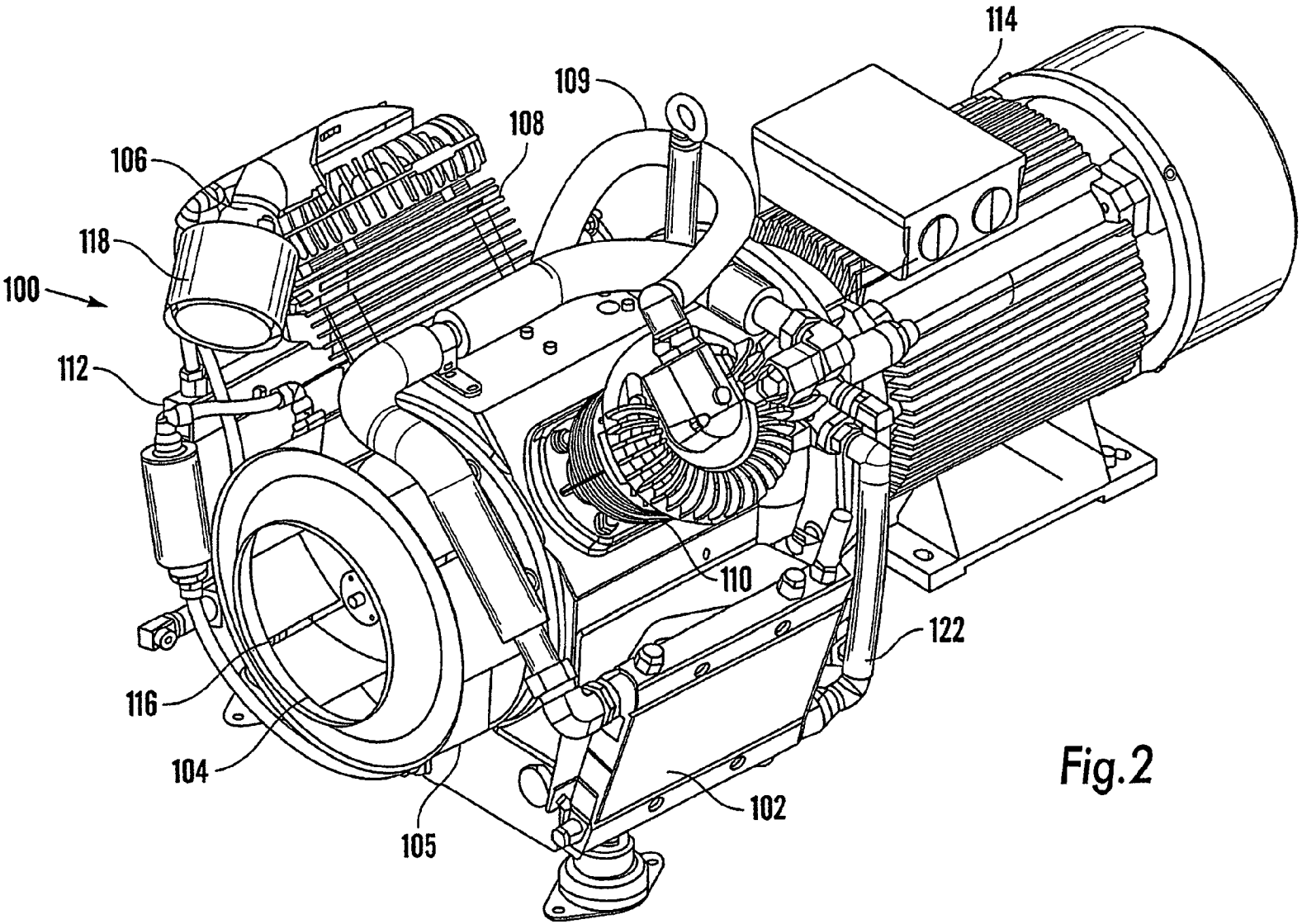
FIG. 2 is a perspective view illustrating an air compressor with parts of the cooling device according to the invention, without the enclosing jacket.

FIG. 2 is a perspective view illustrating an air compressor with a cooling device according to the invention. The enclosing jacket 200 is an essential element in the invention, but in spite of this, for illustrative reasons the jacket 200 is not shown in FIG. 2.

The air compressor 100 is a two-stage cylinder compressor, directly driven by an electric motor 114. The fan 105 is driven by a rotating shaft extension 116 which is connected to or forms a part of the compressor mechanism. In alternative embodiments the fan 105 may be driven by a separate motor, for example an electric motor. The fan 105 is a radial fan, as described with reference to FIG. 1. The fan therefore draws air in through the axial air intake 104 and forces air out in a radial direction in the direction from the shaft towards the surrounding jacket 200 (not shown in FIG. 2). When in operation, therefore, the fan 105 produces an air flow around the compressor 100 and inside the jacket 200. The front cover of the jacket, moreover, is curved backwards at the upper part in order to help to guide the first part of the air flow backwards over the compressor.

The air filter 118 on the air intake 106 is depicted mounted near the outlet from the fan 105, and substantially directed towards this outlet, with the result that the filter has a good supply of cold air from the surroundings that are not heated by the compressor's hot parts or by the drive motor 114 for the compressor. The air intake 106 is connected to the intermediate compressor stage 108, which consists of a cylinder with piston, as well as necessary valve devices for achieving the compressor function. These parts are not particularly relevant to the principle of the invention and are therefore not described further. A connection 109 passes air from the intermediate compressor stage 108 after the air cooler 112 to the output compressor stage 110. The output compressor stage 110 also consists of a cylinder with piston and valve devices (similarly not shown). In the normal manner for this type of compressor, each piston is provided with a connecting rod which rotates eccentrically relative to the compressor's main shaft line. This mechanism is mounted in a crankcase. In the illustrated embodiment the cylinders provided are V-shaped. Lubrication of the movable parts is preferably provided by an oil sump in the crankcase.

In addition to the heat exchangers that cool the compressed air, the compressor itself also requires cooling. The elements of the compressor that have the greatest need for cooling include the cylinder walls and cylinder covers/tops in particular, which are highly subject to heat development as a result of the air compression. The cylinder walls and the covers/tops are therefore provided with cooling ribs, over which the air flowing past inside the jacket 200 passes. The crankcase also requires cooling. This is also provided by the air flowing inside the jacket 200. The compressor may also include special separator devices for separating water from the compressed air, but at the compressor outlet 122 and between the respective compressor stages. If so, these separator devices etc. may also require cooling, even though some of these components are working with the already-cooled compressed air.

Figure 3:
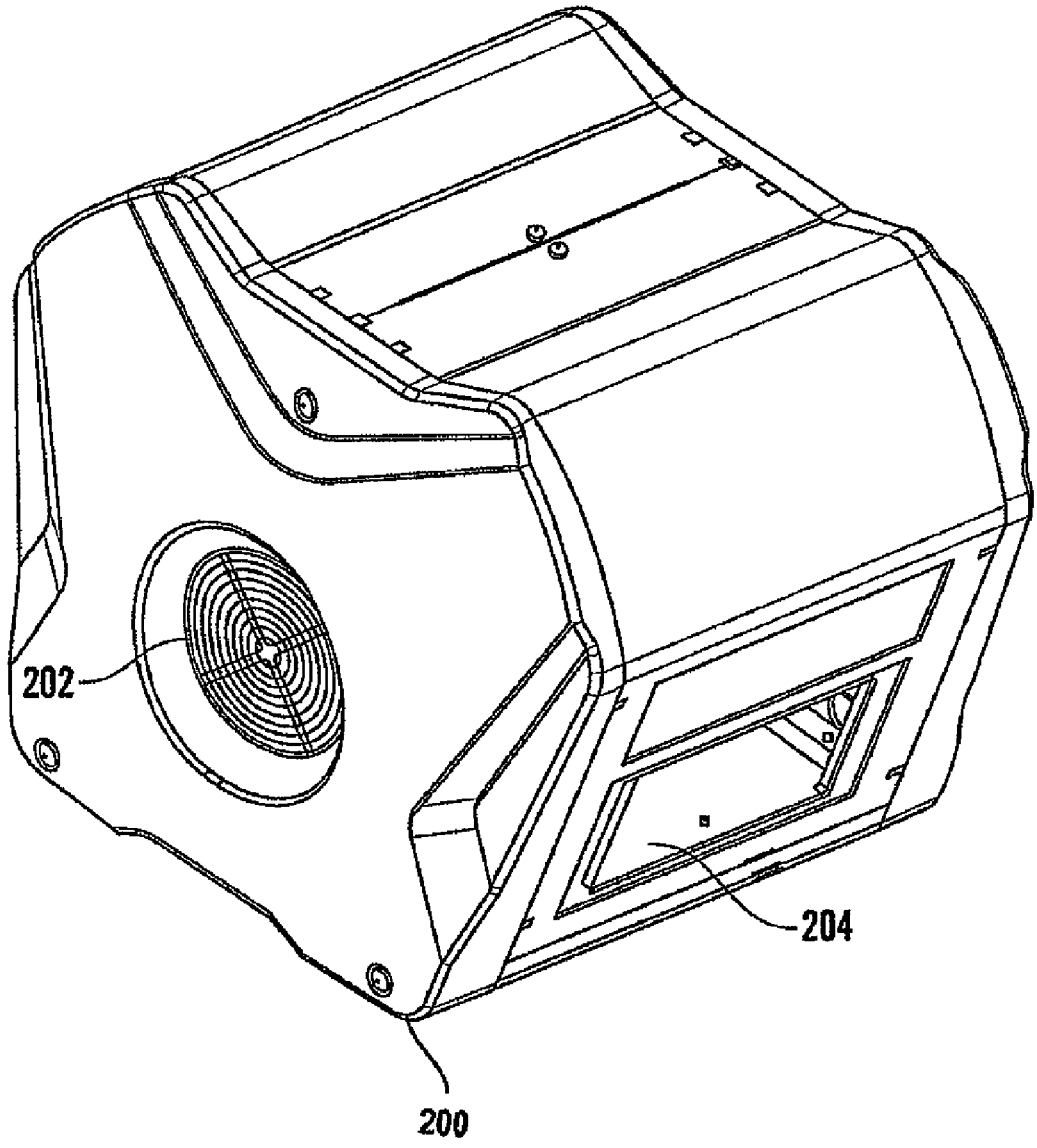
FIG. 3 is a perspective view illustrating the enclosing jacket that forms a part of the cooling device according to the present invention.

FIG. 3 is a perspective view illustrating parts of an air compressor with a cooling device according to the invention, where the enclosing jacket is visible.

The jacket 200 encloses the compressor 100. In FIG. 3 the motor 114 is not shown. In a preferred embodiment the motor 114 will be mounted on the outside of the jacket 200.

The jacket 200 comprises the air intake opening 202, which is provided with a protective grill.

The jacket 200 further comprises the air outlet opening 204, where the output heat exchanger 102 is mounted. On the opposite side the jacket further comprises the air outlet opening 206 (not shown), where the intermediate heat exchanger 112 is mounted.

The jacket 200 further comprises at least one air outlet opening 208 (not shown) on the side of the jacket 200 facing away from the opening 202. Alternatively, the openings 208 may be arranged in other places in the shield. Two such openings 208 are preferably provided.

From the above it will be realized that the relationship between the efficient cooling of the heat exchangers (i.e. the compressed air) and the compressor elements (such as cylinder walls and crankcase) respectively can be influenced and possibly optimised in a simple fashion by the design of the openings in the jacket, particularly the air outlet openings 204, 206, 208, and especially by the design of these openings' areas.

If the openings 204 and 206 are made large relative to the opening(s) 208, a larger portion of the total cooling air through-flow provided by the fan 105 will be used for cooling the heat exchangers and thereby the actual compressed air. If instead the opening 208 is made relatively larger, this will provide increased cooling of the actual machinery in the compressor, such as cylinder walls and crankcase.

The jacket 200, and particularly the openings in the jacket, therefore have a critical influence on the cooling of the air compressor and the air supplied from the compressor.

The jacket 200 will also provide benefits with regard to noise reduction and protection against external environmental influences such as penetration of dust, particles and moisture. The jacket also represents a protection against the risk of coming into contact with hot surfaces.

Figure 4:
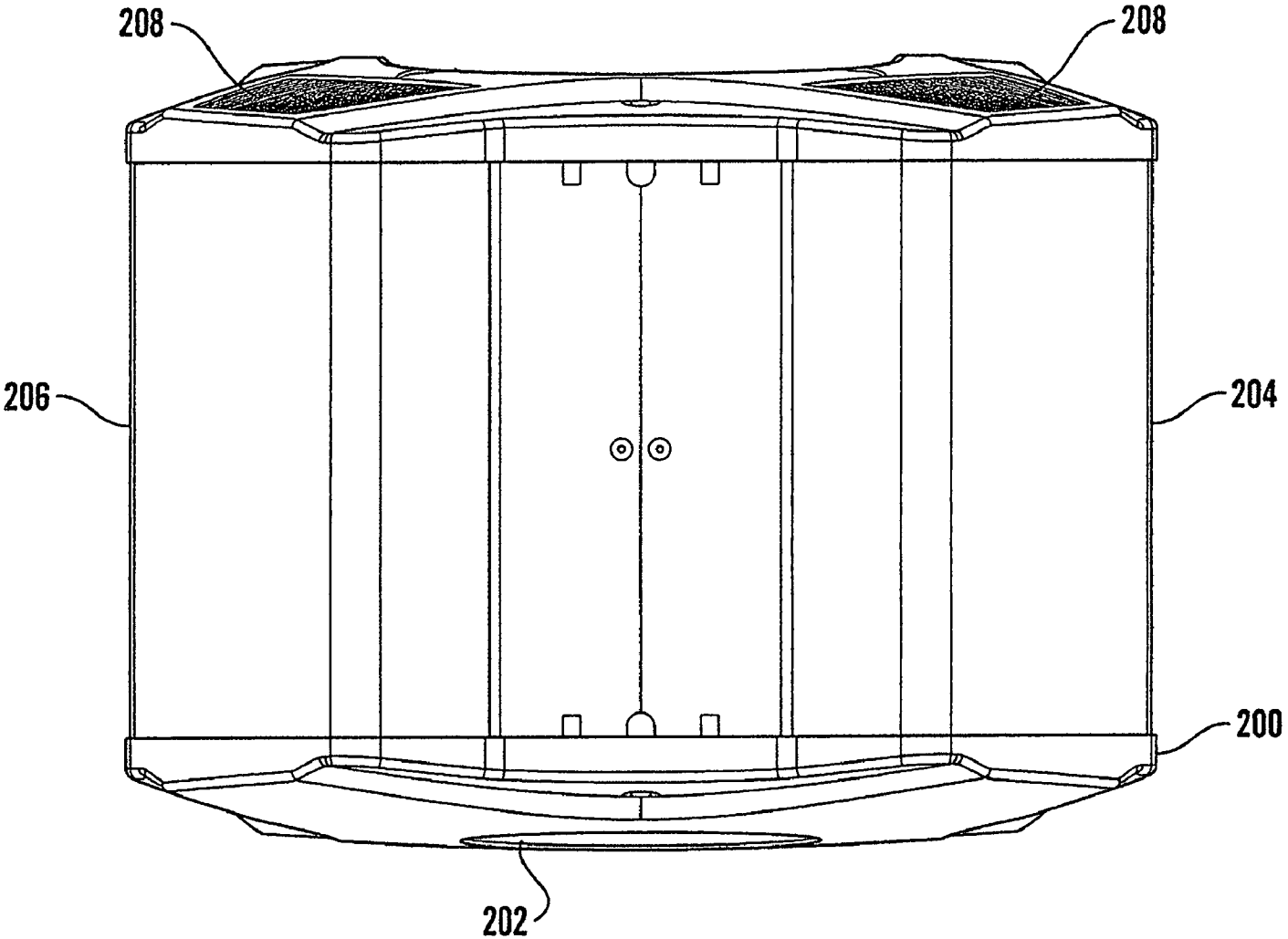
FIG. 4 is a view from above illustrating the enclosing jacket illustrated in FIG. 3.

In FIG. 4 there is further illustrated a view from above of the same jacket as in FIG. 3, where the jacket 200 has the air intake opening 202 at the front, the air outlet openings 204 and 206 on each side adjacent to heat exchangers for compressed air and the air outlet openings 208 for discharging air that cools the actual compressor machinery.

The above detailed description is presented especially with a view to illustrating and describing an advantageous embodiment of the invention. The description, however, in no way limits the invention to the specific embodiment described in detail.

In the detailed, preferred embodiment a multi-stage compressor is employed, and particularly a two-stage compressor. It should be understood that the principle of the invention may also be employed with a single-stage compressor, including only one compressor stage 110 and one heat exchanger 102. Similarly, it will be appreciated that additional compressor stages may be included, for example three or four, and correspondingly additional heat exchangers for cooling the air supplied by the additional stages. There may also be subsequent compressor stages where no heat exchanger is provided for cooling between the stages.

Even though a detailed description is given of a V-type cylinder compressor, with obvious modifications it will be possible to use the invention with compressors where the cylinders have a different configuration, such as an in-line or a single cylinder.

It should be understood that other types of cooling may be employed in addition, for example water or oil cooling, for some or several of the elements that require cooling. Such elements include heat exchangers, cylinder walls, crankcases and separator/condensation devices, cylinder covers/tops.

In the detailed description the motor 114 is kept outside the jacket 200. It will be appreciated, however, that the motor 114 may alternatively be contained in the jacket 200.

Even though the motor 114 is specified as an electric motor, the invention will obviously also be relevant for other types of drive devices.

Further modifications and variations will be obvious to a person skilled in the art in the light of the above description. The scope of the invention will therefore be evident from the patent claims below and their equivalents.

The invention claimed is:

1. A cooling device for an air compressor, which is provided with at least two heat exchangers for cooling of output air, the cooling device comprising:

a jacket enclosing a multistage cylinder compressor including a first compressor stage and a second compressor stage, an air intake opening in the jacket, a fan in connection with the air intake opening, wherein the fan during operation causes an overpressure inside the jacket, a first air outlet opening in the jacket, wherein for cooling of output air from the first compressor stage a first heat exchanger is mounted in the first air outlet opening so that air that cools the first heat exchanger leaves through the first air outlet opening in the jacket, a second air outlet opening in the jacket, wherein for cooling of output air from the second compressor stage a second heat exchanger is mounted in the second air outlet opening so that air that cools the second heat exchanger leaves through the second air outlet opening in the jacket, a third air outlet opening in the jacket for discharging compressed air from the second compressor stage, a fourth air outlet opening in the jacket for discharging air for cooling elements of the compressor, wherein the elements of the compressor comprise at least a cylinder wall, cylinder cover/top, and crankcase, so that air that cools the cooling elements of the compressor leaves through the fourth air outlet opening in the jacket, and wherein the fan is constructed to provide cooling of compressed air from the first compressor stage in the first heat exchanger, cooling of compressed air from the second compressor stage in the second heat exchanger, and cooling of elements of the compressor.

2. A cooling device according to claim 1, wherein the fan is a radial fan.

3. A cooling device according to claim 1, wherein the compressor is driven by a motor and the fan is driven by the compressor, wherein the air contained in the jacket is caused to flow inside the jacket during operation.

4. A cooling device according to claim 1, wherein there is an air gap between the jacket and the elements of the compressor.

5. A cooling device according to claim 1, wherein the elements of the compressor further comprise a separator device for separating water from the air in the compressor.

6. A cooling device according to claim 1, wherein air flow restrictions represented by the air intake opening and the air outlet openings in the jacket are adapted to influence the cooling of compressor elements relative to the cooling of the heat exchangers.

7. A cooling device according to claim 1, wherein the intake of the compressor comprises an air filter and is arranged to receive air directly supplied by the fan.

8. A cooling device according to claim 1, wherein a compressor intake for supplying air to the compressor is provided inside the jacket.

9. A cooling device according to claim 1, wherein a compressor intake for supplying air to the compressor is provided outside the jacket.

* * * * *